US006048023A

United States Patent [19]

Lampton

[11] Patent Number: 6,048,023

[45] Date of Patent: Apr. 11, 2000

[54] MULTI-FUNCTION SUPPORT APPARATUS

[76] Inventor: Ken A. Lampton, 1571 San Francisco St., Redding, Calif. 96001

[21] Appl. No.: 09/123,932

[22] Filed: Jul. 28, 1998

[51] Int. Cl.[7] ..... A47C 13/00; A45F 4/02

[52] U.S. Cl. ..... 297/129; 297/52; 297/188.06; 297/188.07

[58] Field of Search ..... 297/129, 52, 188.06, 297/188.07; 224/155

[56] References Cited

U.S. PATENT DOCUMENTS

| | | | |
|---|---|---|---|
| 319,491 | 6/1885 | King | 297/188.05 X |
| 446,632 | 2/1891 | Easte | 297/188.07 X |
| 665,493 | 1/1901 | White | 297/52 |
| 2,843,185 | 7/1958 | Clem et al. | 224/155 X |
| 3,077,327 | 2/1963 | Batie et al. | 297/52 |
| 3,973,776 | 8/1976 | Olge | 224/155 |
| 4,773,574 | 9/1988 | Burgard . | |
| 5,234,143 | 8/1993 | Mahvi et al. | 224/155 X |
| 5,350,215 | 9/1994 | DeMars | 297/129 X |
| 5,395,023 | 3/1995 | Naymark et al. | 224/245 X |
| 5,409,291 | 4/1995 | Lamb et al. . | |
| 5,527,088 | 6/1996 | MacLean . | |
| 5,533,654 | 7/1996 | Holty et al. . | |
| 5,597,101 | 1/1997 | Barber et al. . | |
| 5,722,717 | 3/1998 | Rettenberger | 297/52 X |
| 5,927,798 | 7/1999 | Ahn | 297/129 |
| 5,957,349 | 9/1999 | Krulik | 24/155 |

FOREIGN PATENT DOCUMENTS

| | | | |
|---|---|---|---|
| 750001 | 11/1933 | France | 297/52 |
| 2552785 | 5/1977 | Germany | 224/155 |
| 1194851 | 6/1970 | United Kingdom | 297/129 |
| 1469054 | 3/1977 | United Kingdom | 297/129 |

*Primary Examiner*—Peter M. Cuomo
*Assistant Examiner*—David E Allred
*Attorney, Agent, or Firm*—Thomas R. Lampe

[57] ABSTRACT

Multi-function support apparatus includes a support frame and a backpack carrier frame pivotally connected to the support frame. The apparatus is convertible to alternatively form a chair, a table-like support for a backpack or for use on the back of a backpacking individual.

4 Claims, 5 Drawing Sheets

MULTI-FUNCTION SUPPORT APPARATUS

TECHNICAL FIELD

This invention relates to support apparatus which can be utilized to perform a number of support functions. More particularly, the apparatus is employable as either a chair, a support positioned on a person's back employed in conjunction with a backpack, or a table-like unit wherein support is provided for a backpack and the backpack is disposed for ease of access.

BACKGROUND OF THE INVENTION

A number of arrangements are disclosed in the prior art for combining a chair and a backpack wherein the chair may be reconfigured to provide a support frame for the backpack and carried on the back of the user. Such devices are disclosed in the following patents: U.S. Pat. No. 5,409,291, issued Apr. 25, 1995, U.S. Pat. No. 5,533,654, issued Jul. 9, 1996, U.S. Pat. No. 4,773,574, issued Sep. 27, 1988, U.S. Pat. No. 5,527,088, issued Jun. 18, 1996 and U.S. Pat. No. 5,597,101, issued Jan. 28, 1997.

DISCLOSURE OF INVENTION

The support apparatus of the present invention also is in the form of a chair and pack frame; however, the present apparatus also readily lends itself to use as a support table for a backpack to facilitate access to the interior of the backpack.

The invention is of relatively simple, inexpensive construction and is also characterized by its reliability of use. The apparatus is quickly convertible to function in any of the three applications thereof.

The multi-function support apparatus of the present invention incorporates a support frame including a first chair frame member having a first pair of legs with ground engaging first leg ends and a first connector member connecting together the legs of the first pair of legs at locations thereon spaced from the first leg ends.

The support frame also includes a second chair frame member having a second pair of legs with ground engaging second leg ends and a second connector member connecting together the legs of the second pair of legs at locations thereon spaced from the second leg ends.

The first and second chair frame members are pivotally connected and movable between a first condition wherein the pairs of legs are generally parallel and a second condition wherein the pairs of legs diverge.

The apparatus also includes a backpack carrier frame pivotally connected to at least one of the chair frame members and selectively movable between a first location wherein the backpack carrier frame is generally vertically oriented and a second location wherein the backpack carrier frame is generally horizontally oriented.

Means is provided for releasably connecting a backpack to the backpack carrier frame, said backpack movable with the backpack carrier frame between a generally vertical orientation and a generally horizontal orientation.

Other features, advantages, and objects of the present invention will become apparent with reference to the following description and accompanying drawings.

BEST MODE FOR CARRYING OUT THE INVENTION

Figure 1:
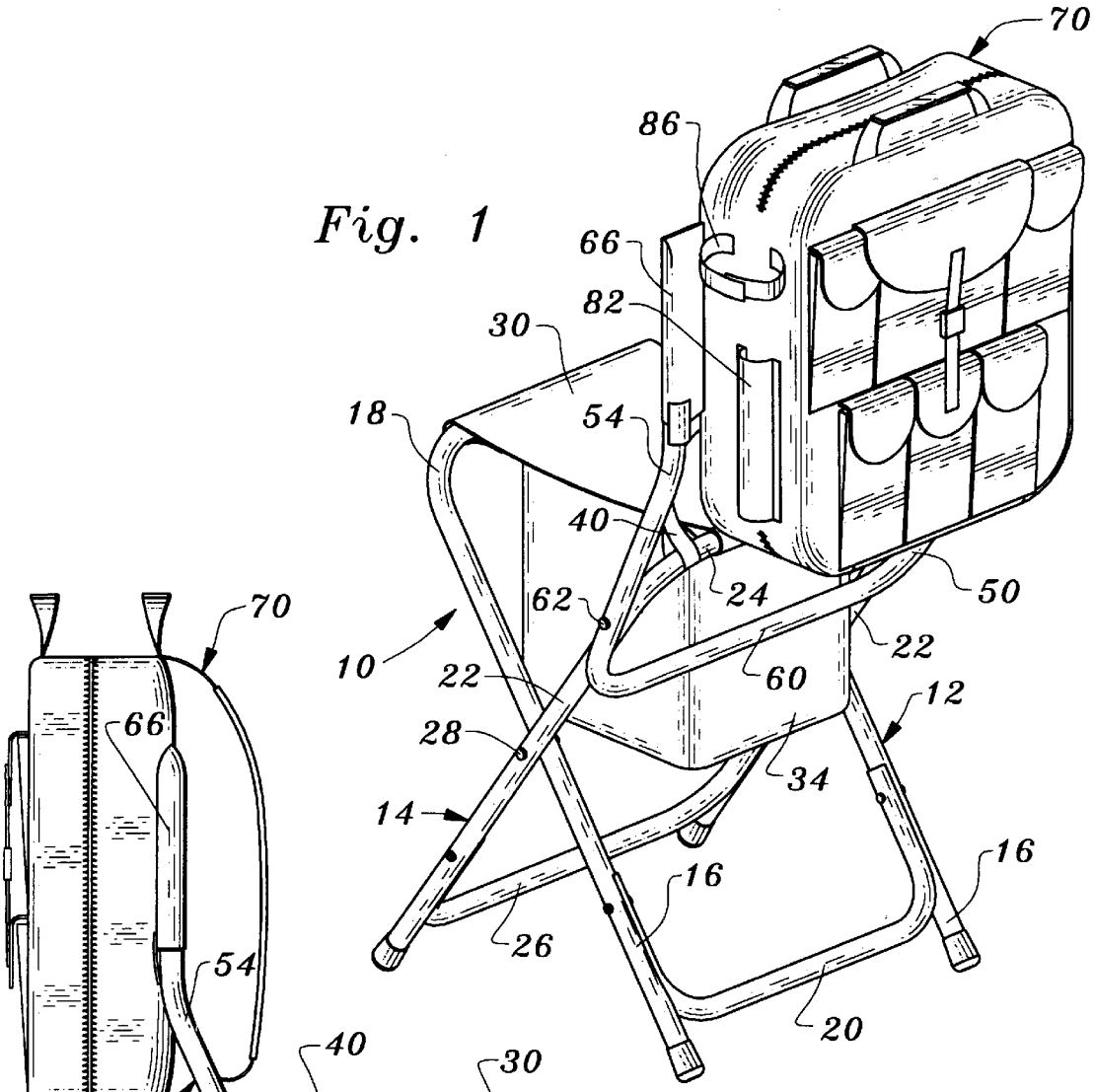
FIG. 1 is a perspective rear view of the apparatus including a support frame, a backpack carrier frame and a backpack disposed in a vertical orientation, the apparatus when so configured being suitable for use as a chair.

Referring now to the drawings, the multi-function support apparatus of the present invention includes a support frame 10 including first chair frame member 12 and second chair frame member 14.

First chair frame member 12 includes a pair of parallel legs 16 having ground engaging leg ends and a connector member 18 connecting legs 16 together at locations thereon spaced from the leg ends thereof. First chair frame member 12 has a generally U-shaped configuration. In the arrangement illustrated, a brace 20 is attached to the legs of the first chair frame member 12 to provide additional stability.

Second chair frame member 14 is also of generally U-shaped configuration and is slightly wider than first chair frame member 12. Second chair frame member 14 includes legs 22 having ground engaging leg ends and a connector member 24 connecting legs 22 together at locations thereon spaced from the leg ends. A brace 26 extends between legs 22 to provide additional stability thereto. The chair frame members each may be suitably formed from bent tubing of aluminum or other material.

The first and second chair frame members are pivotally connected at pivots 28 and are movable relative to one another between a first condition (shown in FIGS. 7 and 8) wherein the pairs of legs are generally parallel and a second condition (shown in FIGS. 1–4, 5, 9 and 10) wherein the pairs of legs diverge to support the apparatus.

Connected to connector members 18, 24 and extending therebetween is a seat element 30 which is formed from flexible sheet material of any suitable type. Seat element 30 is maintained in a taut condition between the first and second connector members when the pairs of legs are in the second condition indicated above, i.e. when the pairs of legs diverge.

Attached to the bottom of seat element 30 by any suitable expedient such as stitching is a storage receptacle in the form of bag 34 having a zippered opening 36 to provide access to the interior thereof. In the arrangement illustrated, a carrier strap 40 is attached to second chair frame member 14 adjacent to the seat element 30 for possible use when transporting the apparatus.

A backpack carrier frame 50 is pivotally connected to the support frame. Backpack carrier frame 50 has a generally U-shaped configuration and includes two spaced carrier frame elements 52, each having a bend 54 formed therein. Each carrier frame element 52 has a distal carrier frame end 56 (see FIGS. 5 and 6). A cross member 60 extends between the carrier frame elements at a location spaced from the distal carrier frame ends 56.

Figure 10:
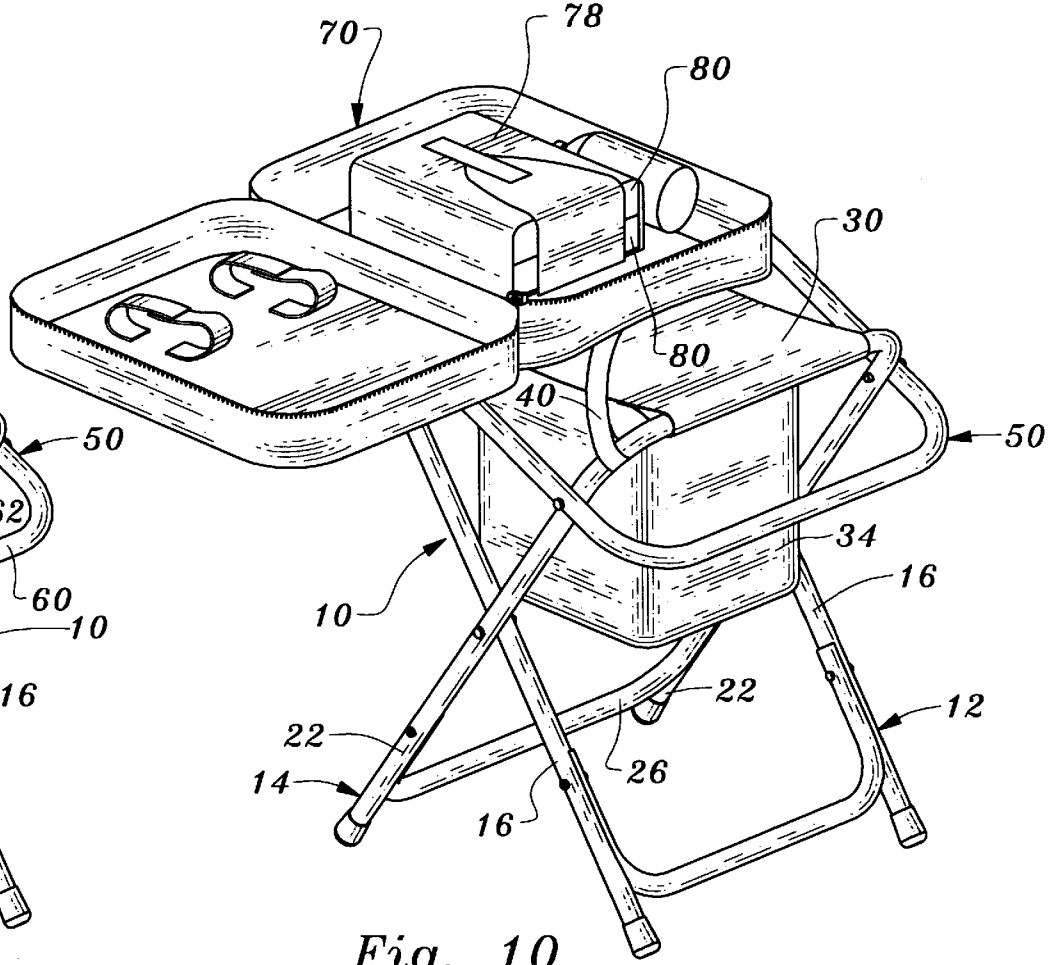
FIG. 10 is a view similar to FIG. 9 but illustrating the backpack in open condition and illustrating structural components within the backpack interior.
Figure 9:
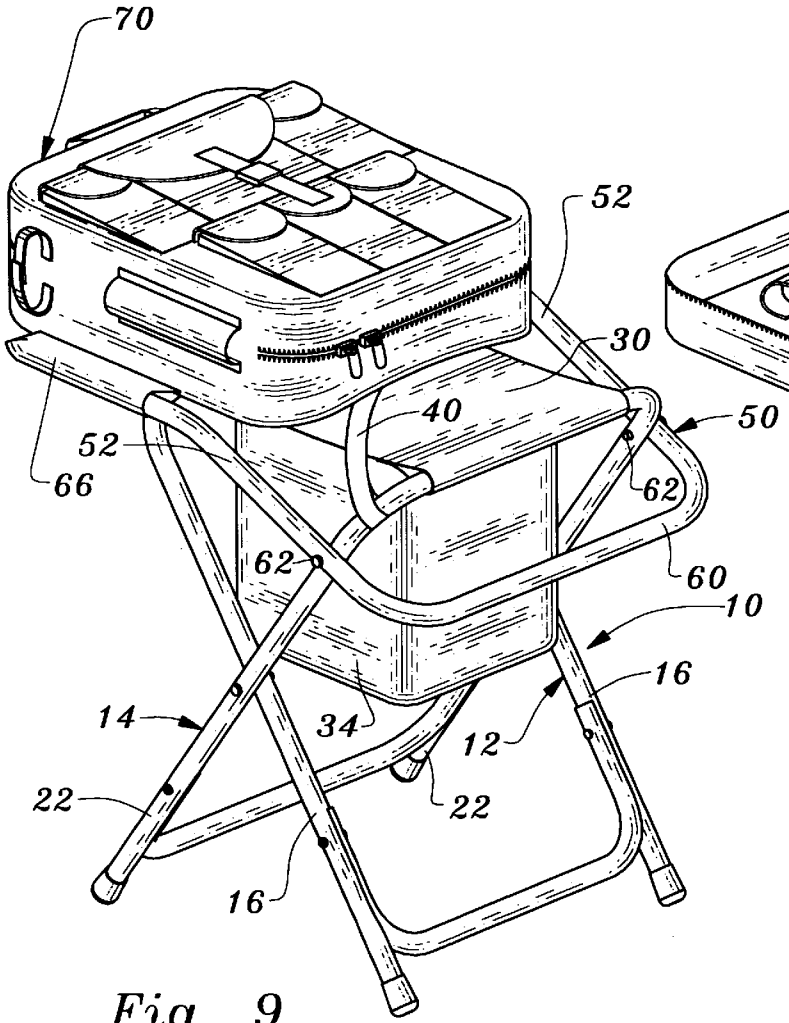
FIG. 9 is a perspective view of the apparatus with the backpack carrier frame and backpack being disposed in a horizontal condition and the backpack supported on a seat element employed in the apparatus.

Backpack carrier frame 50 is pivotally connected to second chair frame member 14 at pivots 62 and is pivotally movable relative to the support frame 10 between the generally vertical orientation shown in FIGS. 1–4 and 5 to the generally horizonal orientation shown in FIGS. 9 and 10. When the backpack carrier frame is in the generally vertical orientation the cross member 60 thereof engages angularly disposed legs 22 of second chair frame member 14 to restrict movement of the backpack carrier frame, the upper portion of the backpack carrier frame including frame ends 56 being disposed on one side of pivots 62 and the cross member 60 being disposed on the other side thereof.

Figure 5:
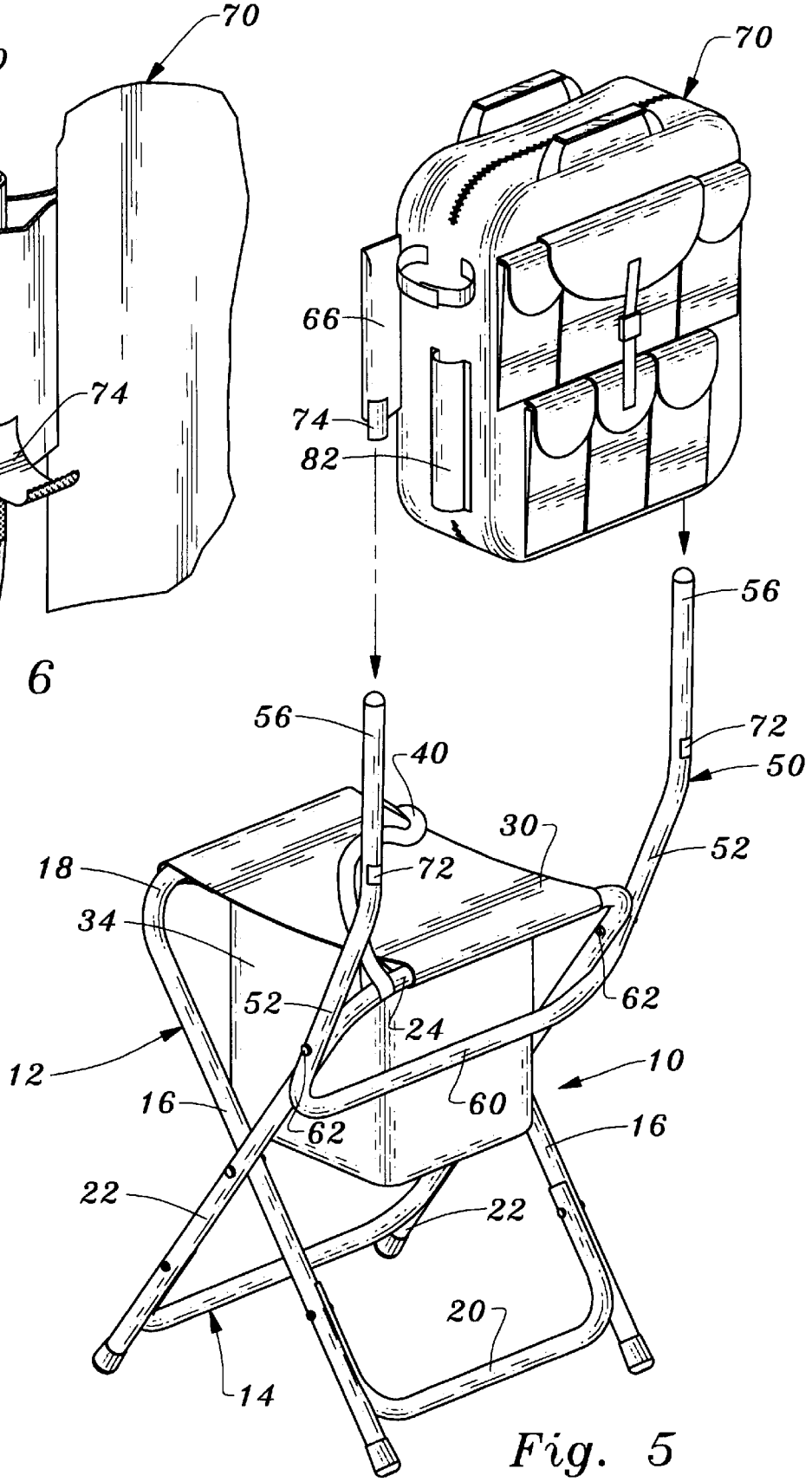
FIG. 5 is a perspective view illustrating a backpack being positioned on the backpack carrier frame of the apparatus.

The distal carrier frame ends 56 of the backpack carrier frame 50 are positionable in pockets 66 disposed at opposed sides of backpack 70. FIG. 5 illustrates backpack 70 being lowered into position on the backpack carrier frame 50.

Figure 6:
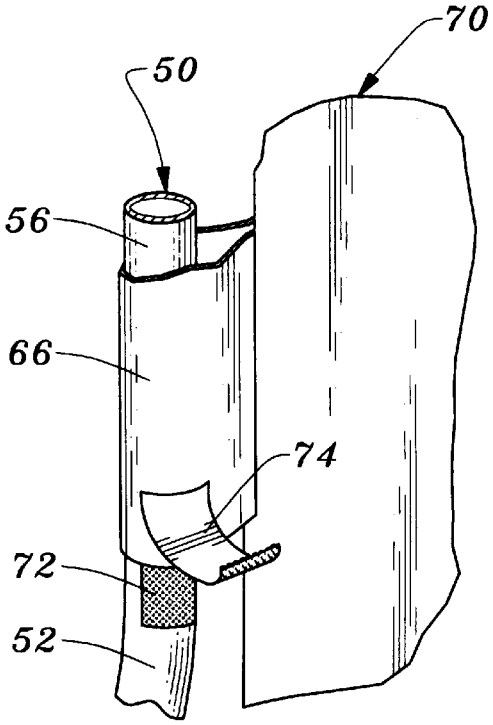
FIG. 6 is an enlarged perspective view illustrating segments of selected components of the apparatus relating to attachment of the backpack to the backpack carrier frame.

Means is provided for releasably connecting the backpack carrier frame to the backpack and releasably retaining the distal carrier frame ends 56 in pockets 66. With reference to FIG. 6, the retention means comprises strips 72, 74 of synthetic materials which adhere when pressed together attached respectively to the distal carrier frame ends 56 and the pockets 66.

Figure 2:
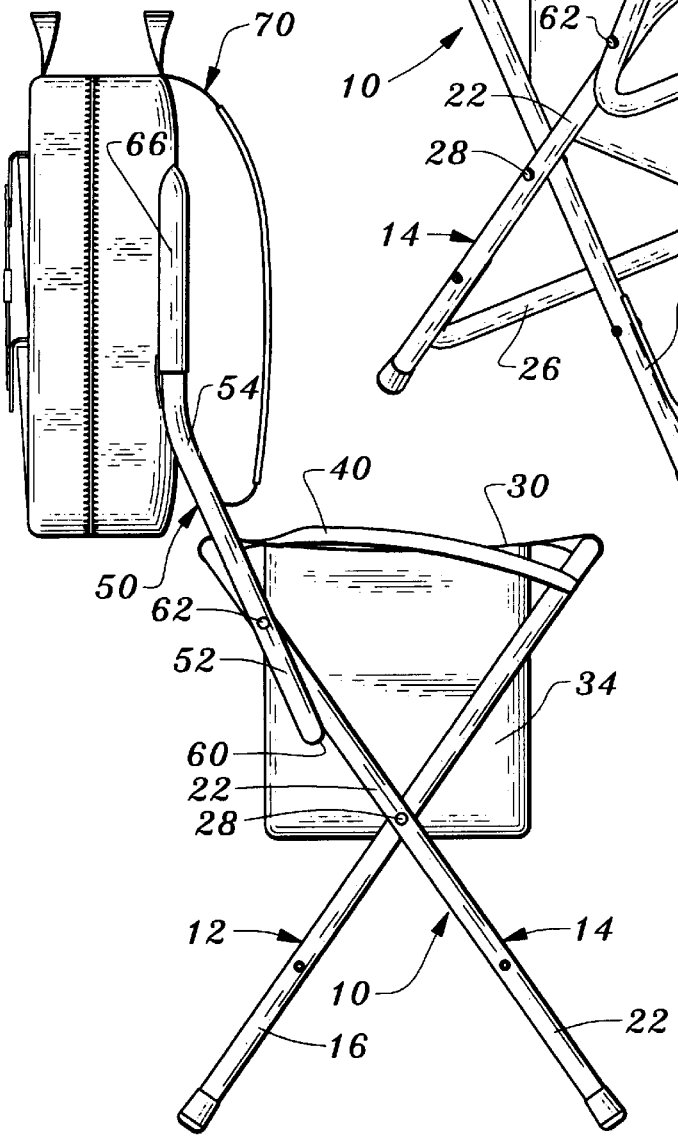
FIG. 2 is a side elevation view of the apparatus in the configuration disclosed in FIG. 1.
Figure 3:
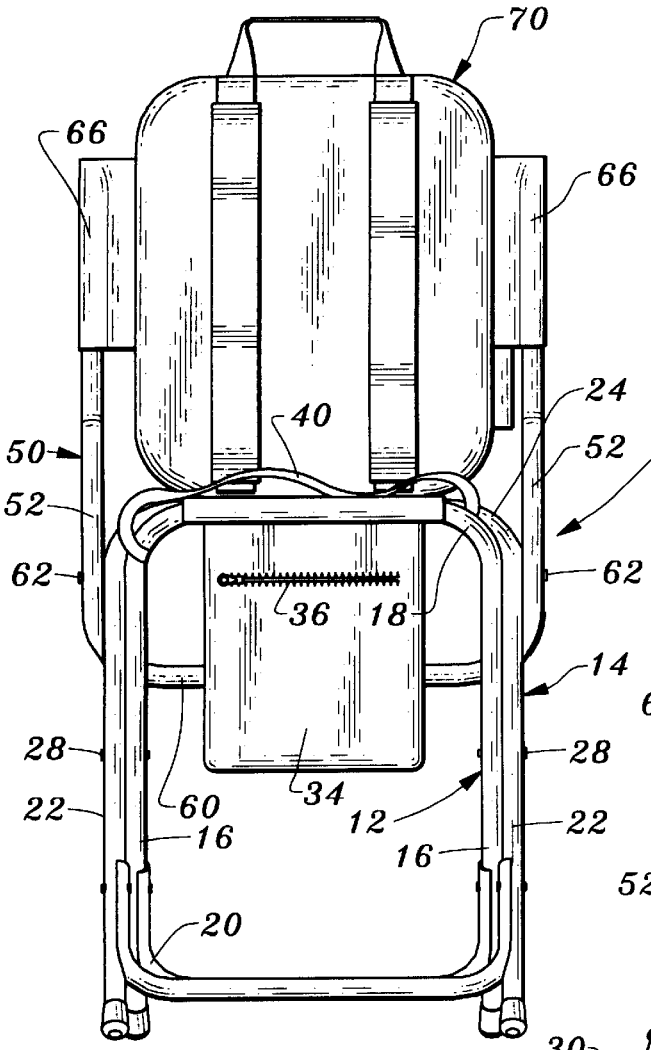
FIG. 3 is a front elevation view of the apparatus.
Figure 4:
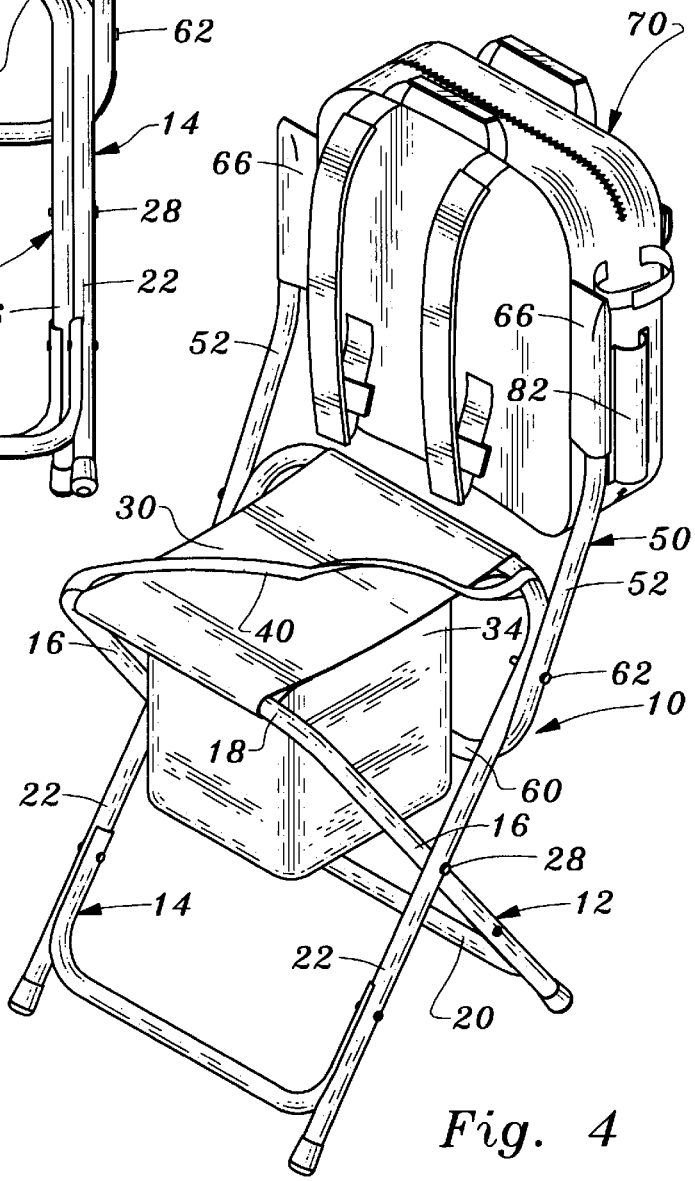
FIG. 4 is a frontal perspective view of the apparatus.

When the structural components of the apparatus are in the relative positions illustrated in FIGS. 1 and 2, for example, the backpack 70 is generally vertically oriented and the backpack functions as a chair back. The center of gravity of the combined backpack and backpack carrier frame is offset rearwardly of pivots 62 and the backpack and backpack carrier frame will remain in such position until an outside force is applied thereto.

FIGS. 9 and 10 illustrate the backpack carrier frame 50 and the backpack 70 in a generally horizonal orientation with the seat element 30 functioning as a support for the backpack. Such horizontal orientation facilitates opening of the backpack to expose the interior thereof as shown in FIG. 10. The backpack is maintained at a convenient elevated location. A plurality of article retaining elements including resilient retaining sleeve 78 are deployed in the interior of the backpack to retain such articles as fishing tackle containers 80.

Figure 7:
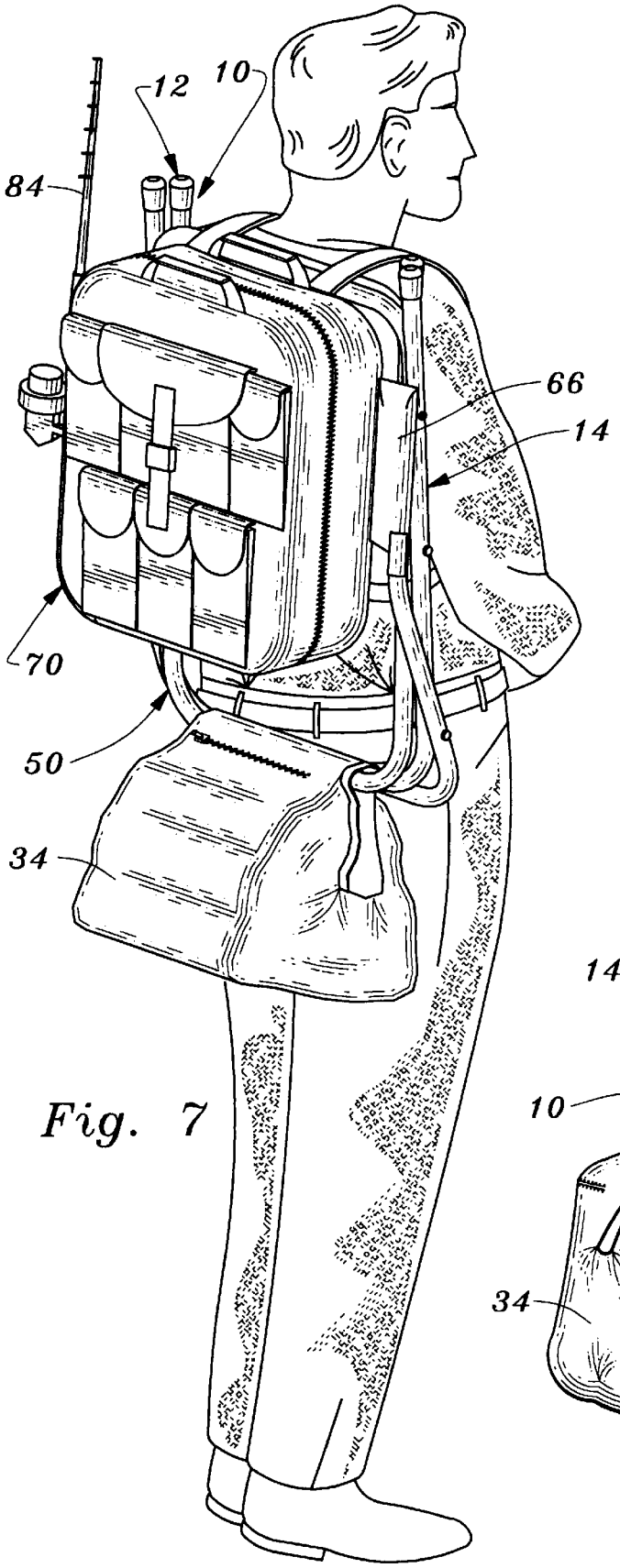
FIG. 7 is a perspective view illustrating the apparatus positioned on the back of an individual.
Figure 8:
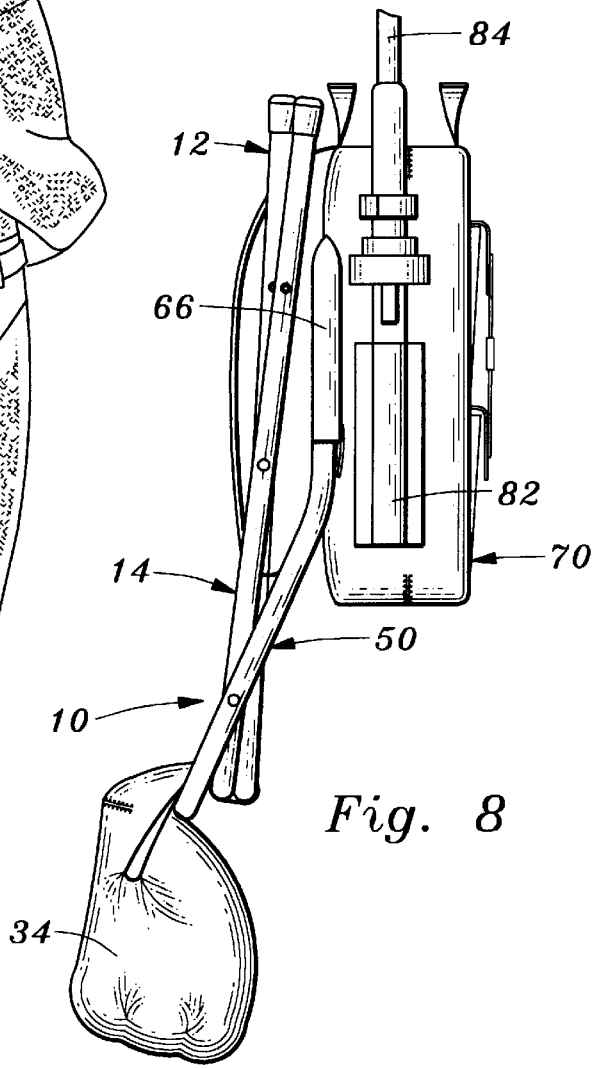
FIG. 8 is a side elevation view of the apparatus in the form assumed thereby when carried on an individual's back.

The support frame, backpack carrier frame and backpack may readily be converted to be carried as a unit on the back of an individual, as shown in FIG. 7. A carrier pocket 82 is utilized to carry a fishing rod 84. A strap 86 can be utilized to stabilize the rod.

What is claimed is:

1. Multi-function support apparatus selectively convertible between a first configuration wherein a backpack of the multi-function support apparatus is supportable on the back of an individual in a generally vertical orientation, a second configuration wherein the multi-function support apparatus is for use as a table with the backpack in a horizontal orientation, and a third configuration wherein the multi-function support apparatus is for use as a chair with the backpack disposed in a generally vertical orientation and functioning as a back of the chair, said multi-function support apparatus comprising, in combination:

a support frame including a first chair frame member having a first pair of legs with ground engaging first leg ends and a first connector member connecting together the legs of said first pair of legs at locations thereon spaced from said first leg ends, a second chair frame member having a second pair of legs with ground engaging second leg ends and a second connector member connecting together the legs of said second pair of legs at locations thereon spaced from said second leg ends, pivots pivotally connecting said first and second chair frame members and said first and second chair frame members movable between a first condition wherein said pairs of legs are generally parallel and a second condition wherein said pairs of legs diverge;

a backpack carrier frame pivotally connected to one of said chair frame members and selectively movable between a first location wherein said backpack carrier frame is generally vertically oriented and a second location wherein said backpack carrier frame is generally horizontally oriented;

a backpack;

means releasably connecting said backpack to said backpack carrier frame, said backpack movable with said backpack carrier frame between a generally vertical orientation and a generally horizontal orientation;

a seat element extending between and attached to said first and second connector members providing support for said backpack with said backpack in a generally horizontal orientation when said pairs of legs are in said second condition and said backpack carrier frame is generally horizontally oriented, said seat element being formed from flexible sheet material and stretched taut between said first and second connector members by opposed forces exerted on said seat element by said first and second connector members when said pairs of legs are in said second condition, said backpack carrier frame having a generally U-shaped configuration and including two spaced carrier frame elements with distal carrier frame ends connected to said backpack, said backpack extending between said spaced distal carrier frame ends and functioning as a chair back when said backpack carrier frame and said backpack are generally vertically oriented, said means for releasably connecting said backpack carrier frame to said backpack comprising a pair of spaced pockets on said backpack receiving said distal carrier frame ends and retainers releasably retaining said distal carrier frame ends in said spaced pockets, said backpack carrier frame additionally including a cross member attached to, extending between and interconnecting said carrier frame elements at locations on said carrier frame elements spaced from said distal carrier frame ends, said carrier frame elements of said backpack carrier frame being pivotally attached to the pair of legs of one of said chair frame members at pivot locations and said cross member engageable with the pair of legs to which said carrier frame elements are pivotally attached to restrict pivotal movement of said backpack carrier frame about said pivot locations, said carrier frame elements each having a bend formed therein to maintain said pack in a generally vertical orientation, said backpack offset rearwardly of said pivot locations when the cross member engages the pair of legs to which the carrier frame elements are pivotally attached, and said cross member engaging the pair of legs to which the carrier frame elements are attached in front of said pivot locations; and a storage receptacle connected to said seat element and disposed below and covered by said seat element when said pairs of legs are in said second condition, said storage receptacle having an access opening formed in a side thereof, said access opening not being covered by said seat element.

2. The multi-function support apparatus according to claim 1 wherein said retainers comprises synthetic materials which adhere when pressed together attached to both said backpack and said backpack carrier frame.

3. The multi-function support apparatus according to claim 1 additionally comprising fishing rod holder means connected to said backpack.

4. The multi-function support apparatus according to claim 1 wherein said backpack defines a backpack interior and includes at least one resilient article retaining sleeve in said interior.

* * * * *